US005509799A

United States Patent [19]

Sher

[11] Patent Number: 5,509,799

[45] Date of Patent: Apr. 23, 1996

[54] FLINT REPLACEABLE LIGHTER

[75] Inventor: Tak C. Sher, North Point, Hong Kong

[73] Assignees: Polycity Industrial Ltd.; Tak Fi International (Holdings) Ltd., both of Quarry Bay, Hong Kong

[21] Appl. No.: 328,670

[22] Filed: Oct. 24, 1994

[51] Int. Cl.[6] ..... F23Q 1/02

[52] U.S. Cl. ..... 431/276

[58] Field of Search ..... 431/276, 277, 431/142, 143, 151

[56] References Cited

U.S. PATENT DOCUMENTS 3,895,904 7/1975 Kimball ..... 431/277
3,966,392 6/1976 Lockwood ..... 431/277

FOREIGN PATENT DOCUMENTS 1176909 8/1964 Germany ..... 431/276

*Primary Examiner*—Carroll B. Dority

*Attorney, Agent, or Firm*—Ladas & Parry

[57] ABSTRACT

The invention is a flint replaceable lighter. In a preferred embodiment the invented lighter includes a lighter body including means for containing fuel. Fitted upon it is a striker wheel assembly including a striker wheel, a striker wheel support superstructure into which the striker wheel is inserted and a hollow support shaft disposed below said superstructure. A flint is loosely disposed in the support shaft, with the upper end of a spring inserted in the support shaft below the flint. The spring urges the flint against the striker wheel above it. When the user removes the spring, the spent flint may be removed and a new one inserted into the shaft. The spring is then reinserted into the shaft as well. The lighter body is outfitted with a means for releasably receiving the striker wheel assembly. In a preferred embodiment orientation means are disposed on the striker wheel assembly and the receiving means for assuring that said striker wheel assembly is received by said receiving means in a correct orientation. When the striker wheel assembly is inserted into the receiving means, it is then swivelled into its operational position.

5 Claims, 7 Drawing Sheets

FLINT REPLACEABLE LIGHTER

BACKGROUND OF THE INVENTION

This invention relates to the field of lighters, such as cigarette lighters.

Lighters, such as modern gas fuel lighters, are often intended to be disposable. That is, the lighter may be made so inexpensively that once either the fuel or flint is consumed, it makes practical sense to simply discard the lighter and replace it with a new one of similar kind rather than expend the money, effort and time to refill the lighter with fuel or to replace its flint. However, with respect to a lighter which is more expensively made, either because of its functional features or because of its aesthetic attributes, it makes more sense to keep the lighter and replace its fuel and flint whenever they are consumed.

The present invention is a lighter having a construction which allows for the quick and facile replacement of a worn out flint with a new one.

SUMMARY OF THE INVENTION

The invention is a flint replaceable lighter. In preferred embodiment the invented lighter includes a lighter body including means for containing fuel. Fitted upon it is a striker wheel assembly including a striker wheel, a striker wheel support superstructure into which the striker wheel is inserted and a hollow support shaft disposed below said superstructure. A flint is loosely disposed in the support shaft, with the upper end of a spring inserted in the support shaft below the flint. The spring urges the flint against the striker wheel above it. When the user removes the spring, the spent flint may be removed and a new one inserted into the shaft. The spring is then reinserted into the shaft as well. The lighter body is outfitted with a means for releasably receiving the striker wheel assembly. In a preferred embodiment orientation means are disposed on the striker wheel assembly and the receiving means for assuring that said striker wheel assembly is received by said receiving means in a correct orientation. When the striker wheel assembly is inserted into the receiving means, it is then swivelled into its operational position.

DETAILED DESCRIPTION OF THE INVENTION

Figure 1:
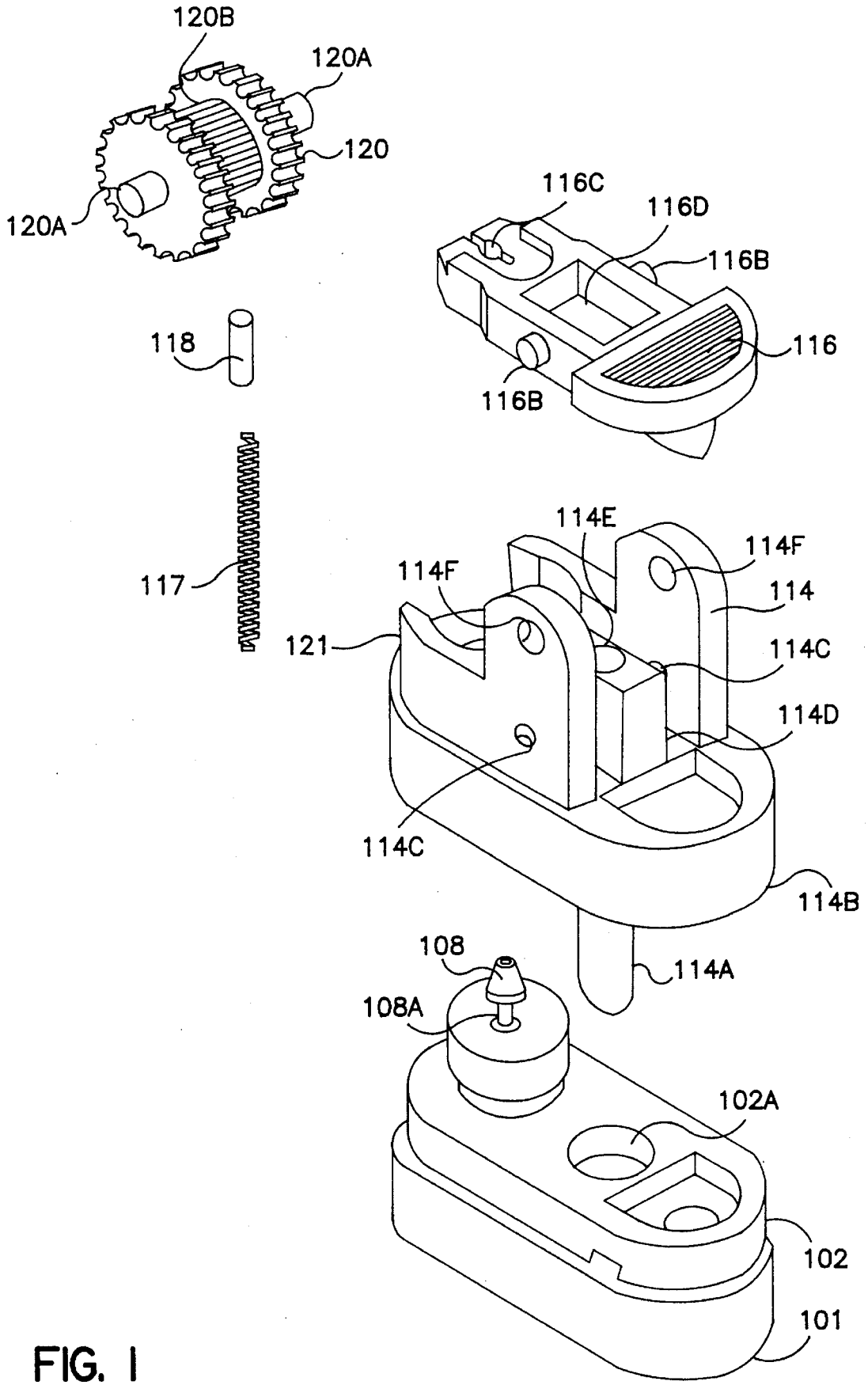
FIG. 1 is an exploded view of a lighter having a conventional arrangement of flint engaging parts.

The preferred embodiment of the invention is illustrated in the attached drawings which are referred to herein. The same reference numeral will be used to identify identical elements throughout the drawings.

FIG. 1 illustrates components commonly mounted on a lighter body 101 in which lighter fuel is contained. Such components include lighter head 102, which serves to seal off the top of the fuel containing portion of the lighter and to provide a platform upon which the lighter's moving parts may be mounted. In this regard, the conventional lighter also includes (i) nozzle assembly 108 which is fitted into the lighter head and is connected to the interior of the lighter's fuel container, and (ii) mounting frame 114 having a post 114A which fits into recess 102A of the lighter head and skirt 114B which fits around the side periphery of the lighter head. The mounting frame includes a windshield 121 which at least partially surrounds the nozzle.

The conventional lighter also includes a nozzle actuating lever 116 having fulcrum lugs 116B which fit into fulcrum lug bearing slots 114C in the mounting frame. The forward end of this lever has a slot 116C into which fits neck 108A of nozzle assembly 108.

In addition, the conventional lighter includes flint spring 117, flint 118 and striker wheel 120. Flint spring 117 and flint 118 fit within the opening 114E in flint receiving member 114D which forms an upstanding part of mounting frame 114. (The actuating lever has a slot 116D so that the lever may fit around the flint receiving member.) Flint 118 is disposed on top of spring 117. Striker wheel lugs 120A of the striker wheel fit into striker wheel lug bearing slots 114F in the mounting frame so that roughened surface 120B of the striker wheel is kept in close proximity to the top of flint receiving member 114D. This prevents the flint and flint spring from falling out of the flint receiving member. The flint spring urges the flint against the roughened surface of the striker wheel so that when the user of the lighter causes the striker wheel to rotate, a spark is created which will ignite fuel ejected from the nozzle.

Once the flint has been used up in such a conventional lighter, the lighter cannot be used any longer even if fuel remains in the container. That is because any attempt to replace the flint would result in permanent damage to the lighter.

Figure 2:
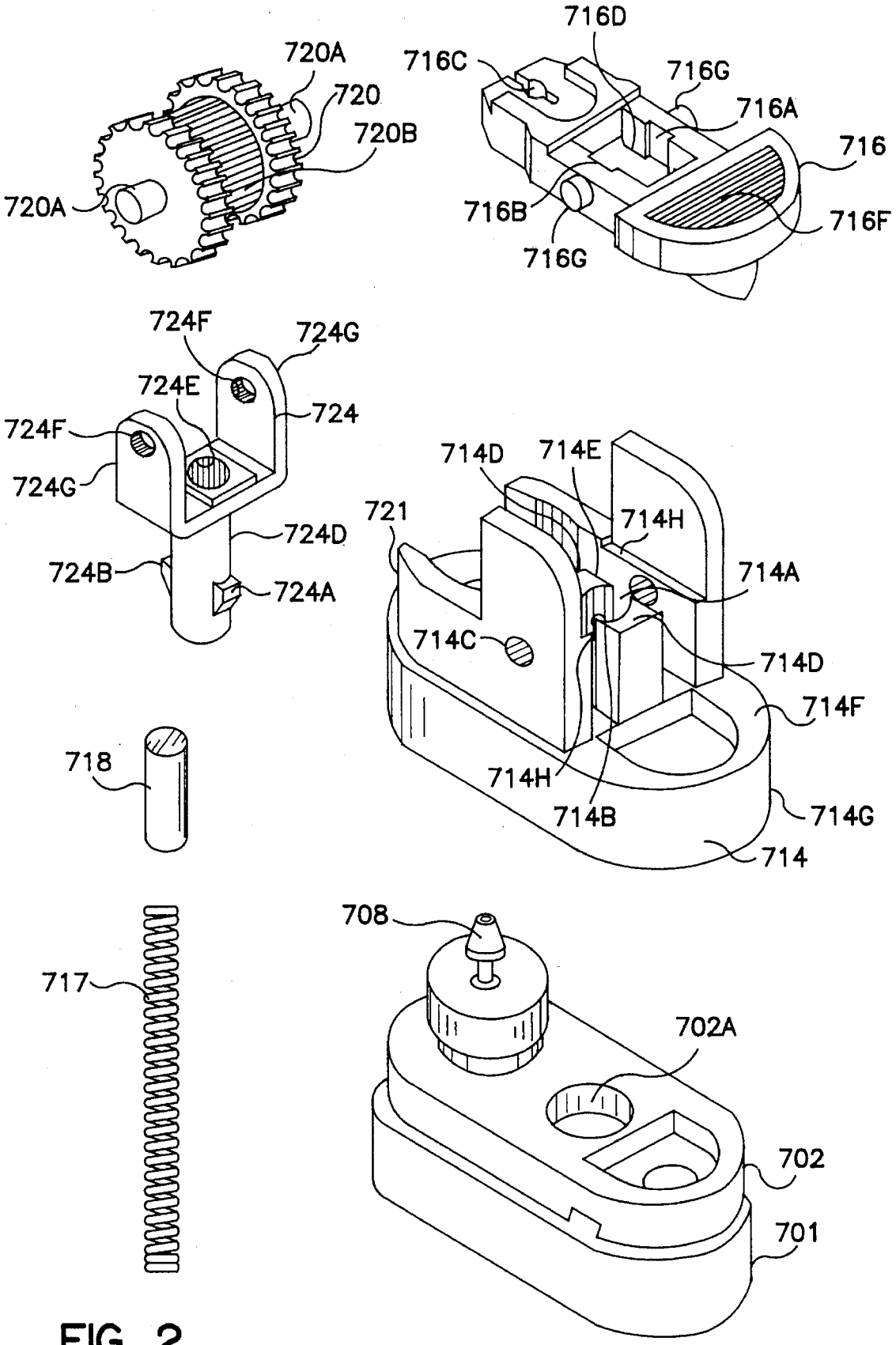
FIG. 2 is an exploded view of a lighter having an arrangement of flint engaging parts in accordance with the present invention.

FIG. 2 illustrates in exploded form the elements of a lighter of the present invention. It includes a lighter body 701 which contains fuel, preferably gas fuel. A lighter head 702 seals off the top of the fuel containing portion of the lighter. Nozzle assembly 708 is fitted on the lighter head in communicating relationship with the interior of the lighter's fuel container. The lighter head also comprises a recess 702A. Mounting frame 714 fits over lighter head 701, with the mounting frame's skirt 714G surrounding the side periphery of the lighter head. The mounting frame includes windshield 721 which at least partially surrounds the nozzle.

Nozzle actuating lever 716, having fulcrum lugs 716G fits on mounting frame 714, with the fulcrum lugs fitting into fulcrum lug bearing slots 714C in the mounting frame. The nozzle actuating lever has a slot 716C formed on its front end so that the front end of the lever may be fitted around the nozzle assembly's neck. An elongated slot (i.e., a slot which is longer in the direction from the front end to the rear end of the nozzle actuating lever where thumb rest 716F is located) is formed in the nozzle actuating lever so that the actuating lever may fit around upstanding receiving member 714D which forms a part of the mounting frame. The upstanding receiving member has an opening 714E therein which aligns with recess 702A of the lighter head when the mounting frame is fitted on the lighter head.

The lighter of the present invention also includes a striker wheel assembly comprised of flint spring 717, a flint 718, a striker wheel 720 and a striker wheel support 724. The striker wheel support comprises a support shaft 724D which has an opening 724E extending therethrough. Striker wheel lugs 720A of the striker wheel fit into the striker wheel lug bearing lots 724F in the superstructure of the striker wheel support. Flint 718 slidably fits within opening 724E. The top portion of flint spring 717 also fits within opening 724E. The flint spring, flint and support shaft all fit through opening 714E and the outer edge of the bottom surface of the superstructure rests upon ledges 714H of the mounting frame when the lighter of the present invention is assembled.

Figure 3:
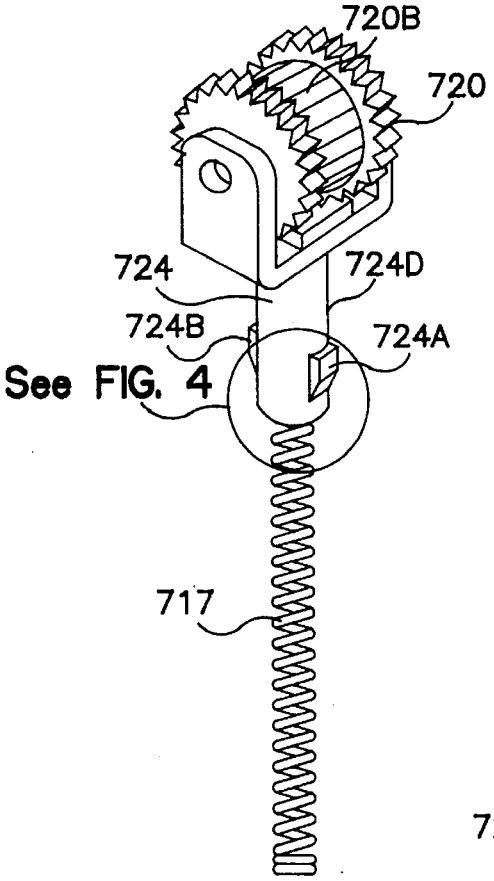
FIG. 3 is a perspective view of a striker wheel assembly of a lighter in accordance with the present invention.

FIG. 3 shows the striker wheel assembly in its assembled condition prior to its insertion into opening 714E in the mounting frame.

Figure 4:
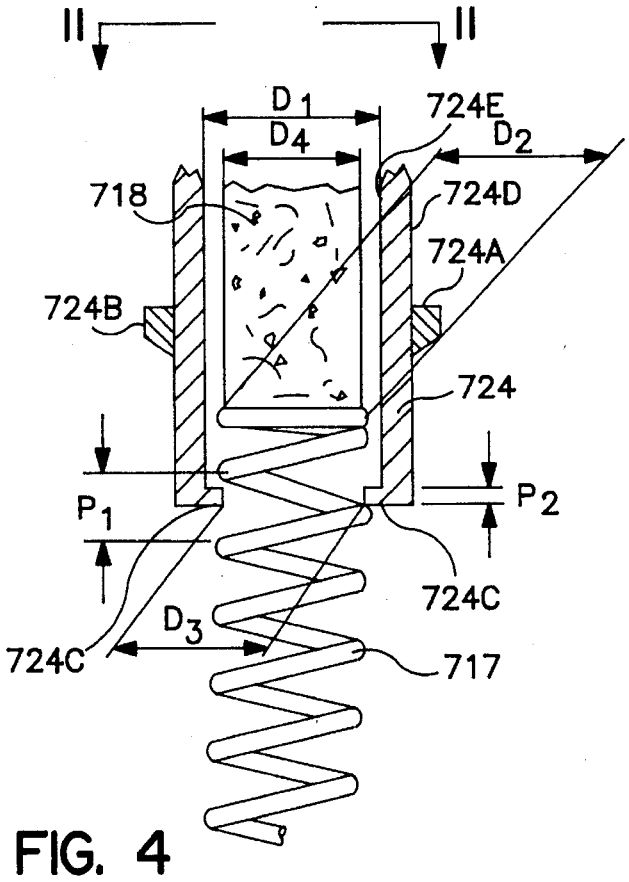
FIG. 4 is a cross-sectioned, side elevational magnified view of that portion of the striker wheel assembly of FIG. 3 shown within the circle labeled "A.+
Figure 11:
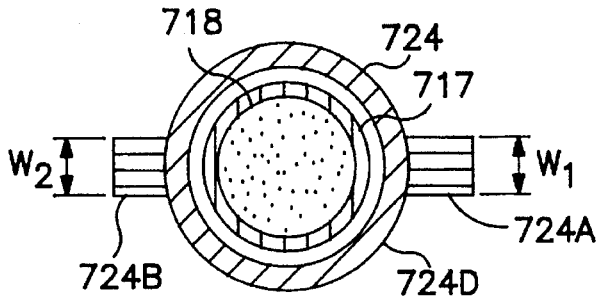
FIG. 11 is a top, cross-sectional view of the striker wheel assembly of the lighter of the present invention taken along line 11—11 of FIG. 4.

FIGS. 4 and 11 show in detail the structure of the striker wheel assembly which prevents the flint and flint spring from falling out of the bottom of the striker wheel support shaft. (The flint and flint spring are prevented from escaping from the top of the support shaft by the presence of the striker wheel.) The bottom of the support shaft has an inwardly extending flange 724C. The flange's inner diameter, $D_3$, is narrower than the outer diameter $D_2$ of the spring. As a result, unless forcefully maneuvered by the lighter's user, the spring cannot fall through the bottom of the support shaft. Pitch $P_1$ of the flint spring is larger than the thickness $P_2$ of the flange 724C, so that once the top end of flint spring is forced into opening 724E, the spring may be screwed upward (by turning the spring in the counterclockwise direction when viewing the striker wheel support assembly from above the shaft) or downward (by turning the spring in the clockwise direction when viewing the striker wheel support assembly from above the shaft). The outer diameter $D_4$ of the flint is narrower than the inner diameter $D_3$ of the flange so that the flint may be easily moved in and out of the opening 724E through the bottom of the shaft during flint replacement procedures. However, outer diameter $D_4$ of the flint is wider than the inner diameter of the spring so that the top end coil of the spring may act as a platform for the flint. Inner diameter $D_1$ is larger that the outer diameter D2 of the spring and the outer Diameter D4 of the flint so that the spring may freely flex and the flint may freely move within opening 724E of the support shaft.

During a flint replacement procedure the spring is screwed downward until the top end coil reaches flange 724C. The top end coil is then forcefully maneuvered out of the shaft. The remnants of the old flint are removed. A new flint is inserted into opening 724E in the bottom of the shaft and then the top coil of the flint spring is forcefully maneuvered into the opening. The spring is screwed upwardly into the shaft up, thereby urging the flint against the roughened surface 720B of the striker wheel. The spring is screwed upward until just before the point that the striker wheel cannot be turned. This assures maximum usage of the new flint before readjustment of the flint height or replacement of the flint is needed.

Striker wheel support assembly also has projections 724A and 724B extending outward from support shaft 724 D. As can be seen in FIG. 11, the width $W_1$ of projection 724A is greater than the width $W_2$ of projection 724B. The purpose for the differences between these widths will be discussed below.

Figure 8:
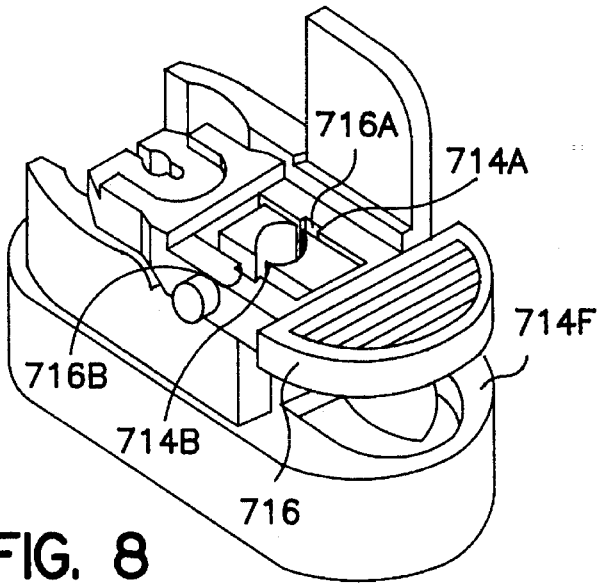
FIG. 8 is a perspective view of the upper portion of the lighter of the present invention with the striker wheel assembly pulled out and held above it.

With reference to FIG. 8, the striker wheel assembly illustrated in FIGS. 3, 4 and 11 is ready to be inserted into the lighter's mounting frame 714 along with actuating lever 716. Slots 714A and 714B are formed in the mounting frame and slots 716A and 716B are formed in actuating lever 716. In order to impart a fixed orientation for the insertion and pull-out of the striker wheel assembly, slots 714B and 716B are formed sufficiently large to accept projection 724B, but not large enough to accept projection 724A. Slots 714A and 716A are large enough to accept projection 724A. As a result, it is impossible to insert the striker wheel into the mounting frame in the wrong orientation. Note that the proper orientation has the striker wheel being spun downward toward projection 724A when the lighter is being used.

Figure 9:
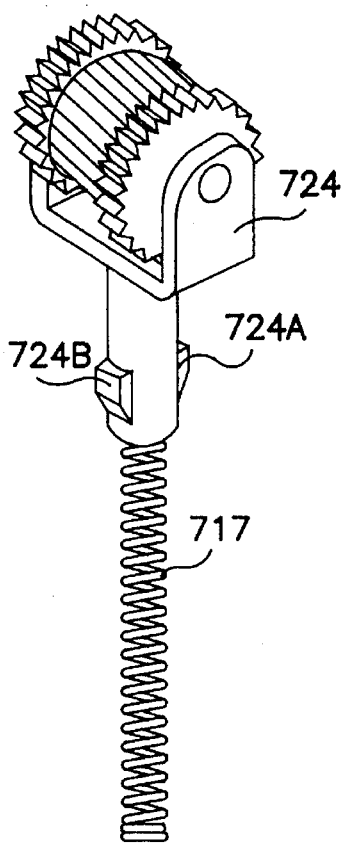
FIG. 9 is an upside down perspective view of the mounting frame of the present invention.
Figure 9:
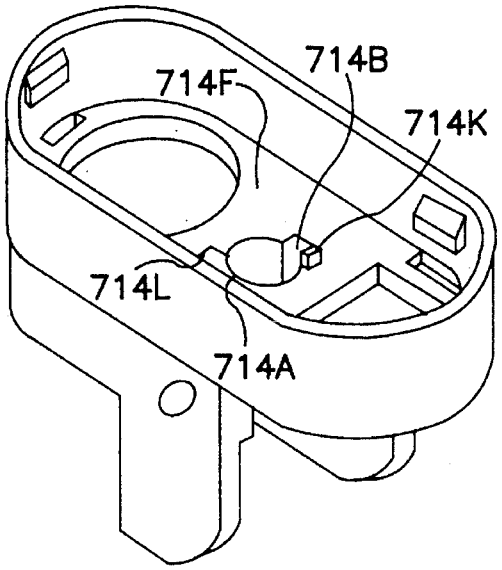

Upon insertion of the striker wheel assembly into the mounting frame (and into the lighter head as well), the bottom of the flint spring engages the bottom of recess 702A in the lighter head and a compressive-elastic force is imparted to the assembly. The striker wheel assembly is pushed further down until projections 724A and 724B are disposed below the platform 714F of the mounting frame. At this point the upper portion of the lighter appears as shown in FIG. 7. The striker wheel assembly is then swivelled 90° in the clockwise direction when viewed from above until the striker wheel assembly comes into the position shown in FIG. 6. As shown in FIG. 9, which shows the underside of the mounting frame, protrusions 714K and 714L prevent the striker wheel from being swivelled in the counterclockwise direction (when viewed from above in FIG. 7), and also act as a stop when the striker wheel assembly reaches the operational position shown in FIG. 6.

Figure 5:
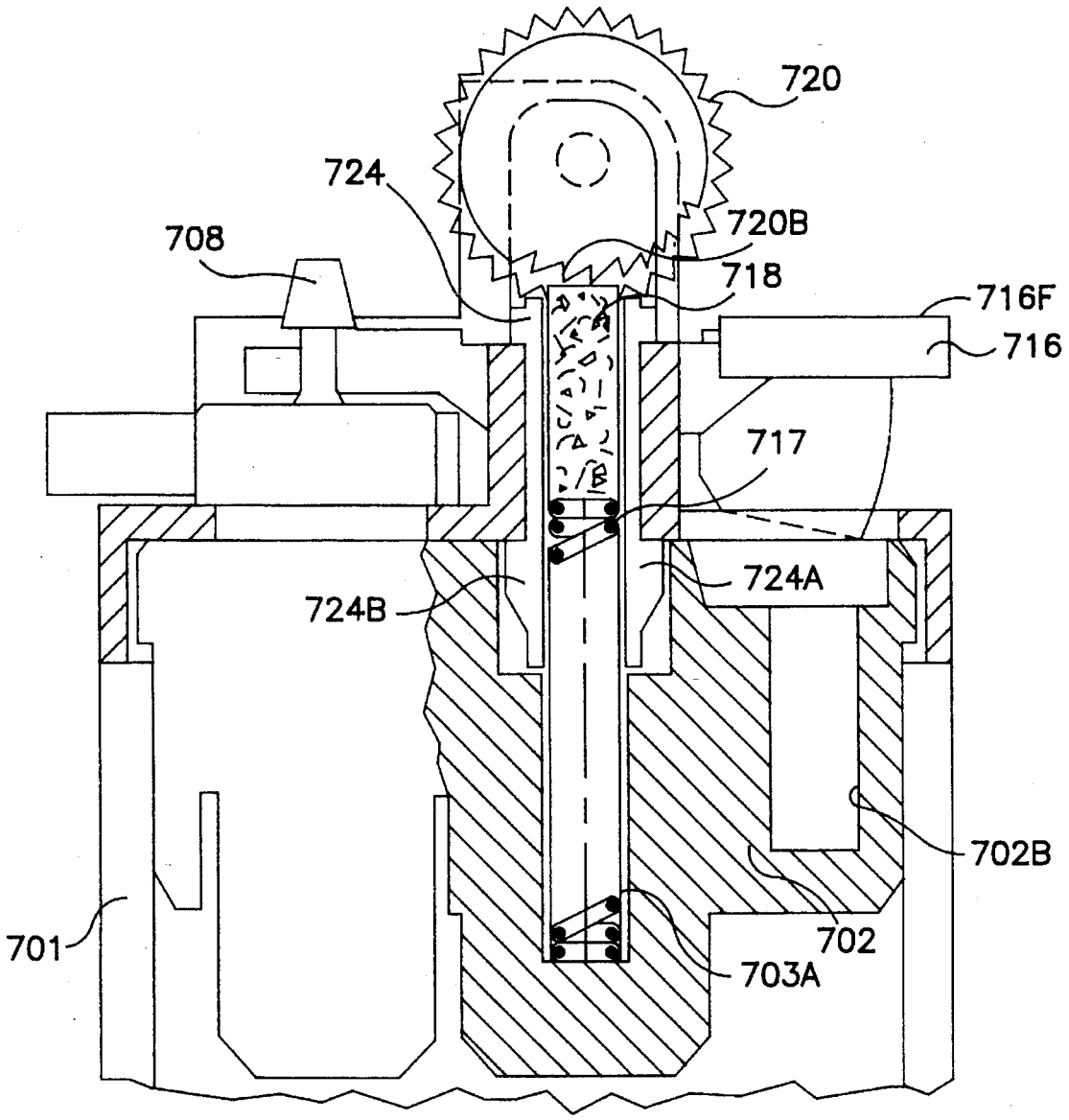
FIG. 5 is a partial side elevational view of the lighter of the present invention in assembled condition, partially broken away and sectioned.

FIG. 5 also illustrates the lighter of the present invention in the operational position. As shown in FIG. 5, the flint spring 717 is supported by the bottom surface of recess 702A of the lighter head, and flint 718 is urged into contact with the striker wheel. Striker wheel 720 is rotated in the clockwise direction as viewed in this figure. Roughened surface 720B strikes against the top of flint 718, thereby creating a spark which ignites the fuel ejected from nozzle assembly 708 which is actuated when lever thumb rest 716F is depressed simultaneously with the rotation of the striker wheel. A second spring, not shown, may be inserted into recess 702B with its top end pressing up against the bottom of the lever thumb rest. This will urge the rear of the lever to rise back up once the user stops depressing the lever thumb rest, and the nozzle assembly will return to the position in which the nozzle is no longer activated.

Figure 6:
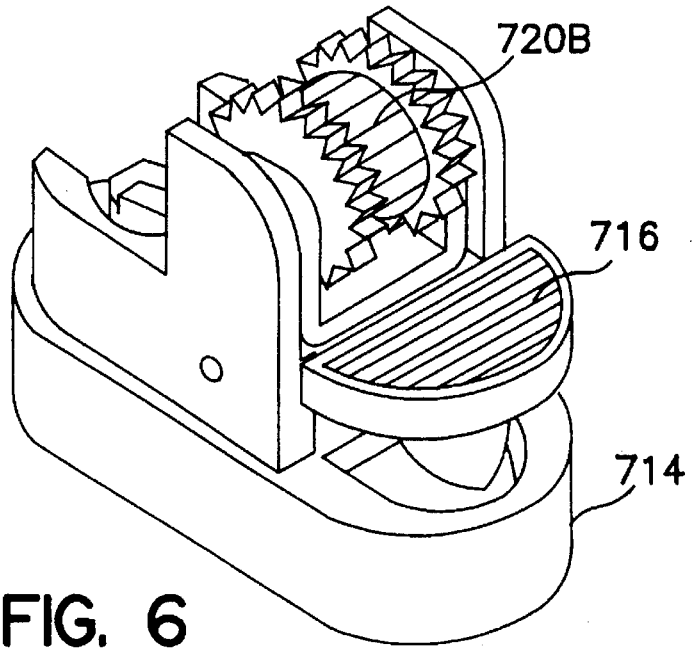
FIG. 6 is a perspective view of the upper portion of the lighter of the present invention in assembled condition.
Figure 7:
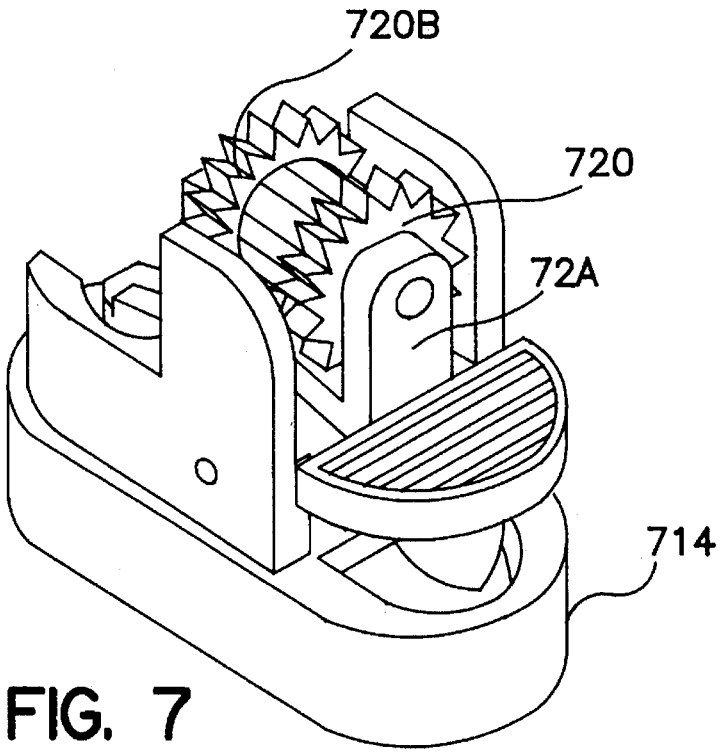
FIG. 7 is a perspective view of the upper portion of the lighter of the present invention with its striker wheel assembly swivelled 90° for pull-out from or insertion into the lighter.
Figure 10:
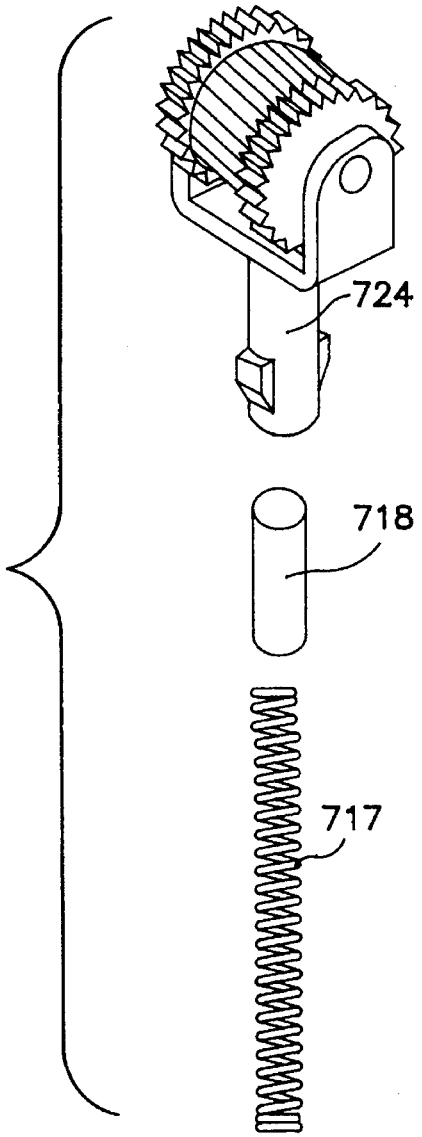
FIG. 10 is a perspective view of the striker wheel assembly with the flint and flint spring detached.

When the flint is to be replaced, the striker wheel assembly is swivelled 90° in the counterclockwise direction as viewed from above in FIG. 6 until the striker wheel assembly is in the position shown in FIG. 7. The striker wheel assembly is pulled up as shown in FIG. 8. The flint spring is screwed out and the remnant of the flint is removed as shown in FIG. 10. Then a new flint is inserted as described in connection with FIGS. 3 and 4.

Above there has been described a unique flint replaceable lighter. It should be understood that various changes of the details, materials, arrangement of parts and uses which have been herein described and illustrated in order to explain the nature of the invention will occur to and may be made by those skilled in the art upon the reading of this disclosure. Such changes are intended to be included within the principles and scope of this invention.

I claim:

1. A flint replaceable lighter comprising:

a lighter body including means for containing fuel;

a striker wheel assembly including a striker wheel, a striker wheel support superstructure into which said striker wheel is inserted, a hollow support shaft disposed below said superstructure, a flint loosely disposed in said support shaft, a spring having an upper end and a lower end, the upper end of which is releasably disposed in said support shaft and abutting against said flint so as to urge it into contact with the striker wheel above it;

receiving means fitted on said lighter body for releasably receiving said support shaft of said striker wheel assembly;

orientation means on said striker wheel assembly and said receiving means for assuring that said striker wheel assembly is received by said receiving means in a correct orientation, wherein said shaft has a lower end with an inwardly extending flange having an internal diameter which is larger than said flint's diameter and smaller than said spring's external diameter, and wherein said shaft has an internal diameter above said flange which is greater than said spring's external diameter, whereby said flint and said flint spring are precluded from falling through said lower end of said shaft under their own weight.

2. A flint replaceable lighter comprising:

a lighter body including means for containing fuel;

a striker wheel assembly including a striker wheel, a striker wheel support superstructure into which said striker wheel is inserted, a hollow support shaft disposed below said superstructure, a flint loosely disposed in said support shaft, a spring having an upper end and a lower end, the upper end of which is releasably disposed in said support shaft and abutting against said flint so as to urge it into contact with the striker wheel above it;

receiving means fitted on said lighter body for releasably receiving said support shaft of said striker wheel assembly;

orientation means on said striker wheel assembly and said receiving means for assuring that said striker wheel assembly is received by said receiving means in a correct orientation, wherein said orientation means comprises a projection extending outward from said shaft and a slot formed in said receiving means, which slot corresponds to said projection.

3. The lighter of claim 1 wherein said inwardly extending flange has a height and wherein said spring has a pitch which is greater than said height.

4. The lighter of claim 2 wherein said receiving means comprises a platform having an upper surface and a lower surface, wherein said slot is formed in said platform such that it passes through both said upper and lower surfaces, said platform having a protrusion extending downward from said lower surface, said protrusion acting so as to interact with said projection such that once said projection of said support shaft is passed through said slot, said striker wheel assembly may be rotated in only one direction.

5. The lighter of claim 1 wherein said orientation means comprises a projection extending outward from said shaft and a slot formed in said receiving means, which slot corresponds to said projection.

* * * * *